US006032393A

United States Patent [19]

Maxim

[11] Patent Number: 6,032,393

[45] Date of Patent: Mar. 7, 2000

[54] ROTATABLE PEG ILLUMINATED PICTURE BOARD

[76] Inventor: John G. Maxim, 863 Coventry St., Boca Raton, Fla. 33487-3106

[21] Appl. No.: 09/079,631

[22] Filed: May 15, 1998

[51] Int. Cl.[7] ..... G09F 13/00

[52] U.S. Cl. ..... 40/548; 40/547; 40/579; 434/96

[58] Field of Search ..... 40/619, 622, 492, 40/486, 581, 550, 546, 547, 579; 362/29, 293, 332, 335, 559; 446/91, 485; 116/223, 286, 302, 309

[56] References Cited

U.S. PATENT DOCUMENTS

| | | | |
|---|---|---|---|
| 1,460,644 | 7/1923 | Dollison et al. | 362/293 X |
| 1,526,425 | 2/1925 | Limpert | 40/579 |
| 2,125,403 | 8/1938 | Slutsky | 40/579 |
| 3,530,615 | 9/1970 | Meyer | 40/547 X |
| 3,749,903 | 7/1973 | Belokin, Jr. | 40/581 X |
| 3,766,376 | 10/1973 | Sadacca et al. | 40/547 X |
| 4,917,448 | 4/1990 | Oppenheimer | 362/559 X |
| 5,029,047 | 7/1991 | Kachel | 40/547 X |
| 5,121,926 | 6/1992 | Pfaender | 40/547 X |
| 5,391,105 | 2/1995 | Jones | 40/547 X |
| 5,704,789 | 1/1998 | Yang | 40/579 X |
| 5,829,863 | 11/1998 | Gutshell | 362/293 X |
| 5,865,533 | 2/1999 | Liu | 362/293 X |

*Primary Examiner*—Anthony Knight
*Assistant Examiner*—Mark Williams
*Attorney, Agent, or Firm*—Oltman, Flynn & Kubler

[57] ABSTRACT

An image generating board apparatus is provided, including an image display board having an array of peg ports, pegs formed of translucent and colorless material rotatably fitted into each of at least two of the peg ports, each peg having a peg distal end which is substantially planar and is fitted with a polarized film section, and each peg having a peg proximal end, a light source adjacent to the display board and to the peg distal ends, a polarized film sheet mounted to extend between the light source and the peg distal ends and with its polarization axis angled relative to the polarization axis of the film sheet, and a tape sheet mounted to pass between the film sheet and the peg distal ends, so that light from the light source shines through the film sheet, through the tape sheet, and through the film sections at the peg distal ends and isolates and selectively passes into each peg an isolated wavelength of visible light from the light source, the isolated wavelength illuminating each peg with a color corresponding to each isolated wavelength, and so that rotating any given peg causes the film section of the peg to shift its relative alignment with the film sheet and the tape sheet polarization axes, thereby shifting the wavelength isolated and projecting into the peg to a different illuminated color.

10 Claims, 6 Drawing Sheets

ROTATABLE PEG ILLUMINATED PICTURE BOARD

BACKGROUND OF THE INVENTION

1. Field of the Invention

The present invention relates generally to the field of personal entertainment devices including toys. More specifically the present invention relates to an image generating apparatus including an image display board having an array of peg ports, each peg port being rotatably fitted with a translucent colorless peg having a planar peg distal end covered with a translucent polarized film section, a light source behind and directed toward the board, a translucent polarized film sheet mounted to extend between the light source and the peg distal ends, and a tape sheet formed of suitable tape or cellophane mounted to extend between the film sheet and the peg distal ends. The tape sheet and film sheet are both preferably mounted face to face to each other and the film sheet to a transparent mounting panel. The polarization axis of the tape sheet is oriented at an angle, preferably a forty-five degree angle, relative to the polarization axis of the film sheet.

As a result of this construction, light shining from the light source through the film sheet, through the tape sheet, and through the film section on the peg distal ends causes an isolated wavelength of visible light to pass into each given peg. The isolated wavelength illuminates the given peg so that the peg glows the corresponding color when seen from the forward side of the display board. Rotating any given peg shifts the selected wavelength to produce a different illuminated color in the peg. By selecting different colors for the various pegs on the display board, an illuminated color pattern or a picture of something may be created.

2. Description of the Prior Art

There have long been board games in which various patterns are created from illuminated elements. These have taken the form of tinted and polarized sheet portions which are positioned one over the other to create desired patterns. A problem with these prior devices has been that in some instances the illumination elements have to be removed and thereby subjected to the possibility of loss to change the color or pattern. Another problem has been that the range of color choices for elements, whether mounted individually or overlaid with other elements, has been highly limited.

It is thus an object of the present invention to provide an image creating apparatus having lighted elements in the form of translucent pegs capable of illumination in various colors to combine to form an image such as a pattern or a picture.

It is another object of the present invention to provide such an apparatus in which the peg color is changed without peg removal, so that no pegs are lost and for greater ease of operation.

It is still another object of the present invention to provide such an apparatus which can produce color in a peg from virtually any point along the visible spectrum.

It is finally an object of the present invention to provide such an apparatus which is compact, light weight, easy to use and inexpensive to manufacture.

SUMMARY OF THE INVENTION

The present invention accomplishes the above-stated objectives, as well as others, as may be determined by a fair reading and interpretation of the entire specification.

An image generating board apparatus is provided, including an image display board having an array of peg ports, pegs formed of translucent and colorless material rotatably fitted into each of at least two of the peg ports, each peg having a peg distal end which is substantially planar and is fitted with a polarized film section, and each peg having a peg proximal end, a light source adjacent to the display board and to the peg distal ends, a polarized film sheet mounted to extend between the light source and the peg distal ends and with its polarization axis angled relative to the polarization axis of the film sheet, and a tape sheet mounted to pass between the film sheet and the peg distal ends, so that light from the light source shines through the film sheet, through the tape sheet, and through the film sections at the peg distal ends and isolates and selectively passes into each peg an isolated wavelength of visible light from the light source, the isolated wavelength illuminating each peg with a color corresponding to each isolated wavelength, and so that rotating any given peg causes the film section of the peg to shift its relative alignment with the film sheet and the tape sheet polarization axes, thereby shifting the wavelength isolated and projecting into the peg to a different illuminated color.

The polarization axis of the tape sheet preferably is oriented at an angle of forty-five degrees relative to the polarization axis of the film sheet. The apparatus preferably additionally includes an apparatus housing containing the light source, the film sheet and the tape sheet, where the display board forms a forward wall of the apparatus housing. The light source preferably is an incandescent bulb.

The apparatus preferably additionally includes a power source, where the apparatus housing contains the power source and contains an electric circuit for delivering power from the power source to the light source. The apparatus preferably additionally includes a battery clip structure within the apparatus housing, where the power source includes at least one D battery replaceably mounted in the battery clip structure. The apparatus preferably additionally includes a battery access door in the apparatus housing for accessing the at least one D battery. The electric circuit preferably includes a switch having a switch actuation lever protruding through a switch opening in the apparatus housing for controlling the flow of electric current to the light source. The apparatus preferably additionally includes a funnel-shaped reflector having a narrow end and a wide end, the reflector opening at the narrow end around the light source and expanding toward the display board, so that the wide end surrounds the peg distal ends.

The pegs are each preferably cylindrically shaped and are each preferably formed of translucent plastic, and the each have a peg distal end which is wider than the peg proximal end, so that a step is defined between the peg distal end and the peg proximal end for abutting the board surrounding the peg port.

The apparatus preferably additionally includes a wand for individually rotating the pegs to produce the color changes, the wand having a clear translucent body with a wand distal end and a wand proximal end, the wand distal end having peg engaging structure and the wand proximal end having a finger gripping portion. The wand preferably has a viewing section at the center of the gripping portion and along the wand body longitudinal axis, into which the player looks to see the color of light entering the given peg at each moment during peg rotation, so that rotation may be stopped at the moment the desired color is projected into the given peg. The peg engaging structure preferably includes a peg receiving opening in the wand body having a diameter close enough to the diameter of each of the pegs that a friction fit is produced between the given peg being engaged and the wand for peg engagement during peg rotation.

The apparatus preferably additionally includes a template for aiding the player in image creation, the template including a sheet of material having peg receiving holes corresponding to locations on the display board, and adjacent to each peg receiving hole the template has a color mark corresponding to the color the particular adjacent peg is to be illuminated to produce a specific collective peg color image on the display board, so that the player places the template on the display board with the pegs passing into the peg receiving holes and rotates the pegs one by one until each peg is illuminated with a color corresponding to the specific adjacent mark color. The sheet of material optionally is formed of a resilient plastic. The apparatus preferably includes several of these templates, each of the templates producing its own unique image.

A method of creating an illuminated image using the above-described image generating board apparatus includes the steps of: activating the light source, and rotating the pegs one by one until each peg is illuminated with a selected color so that the pegs are collectively illuminated with colors forming a desired image.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
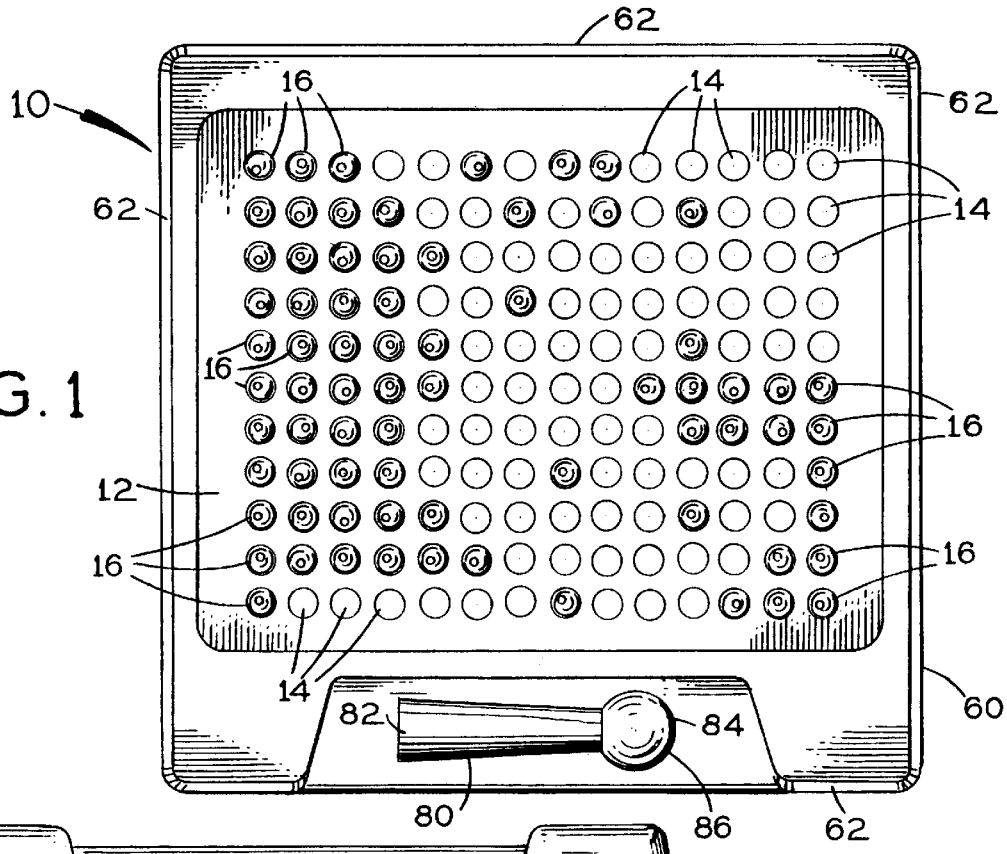
FIG. 1 is a perspective top view of the preferred embodiment of the image creating apparatus, with the peg rotating wand lying in a tray-shaped recess in the housing display panel.
Figure 3:
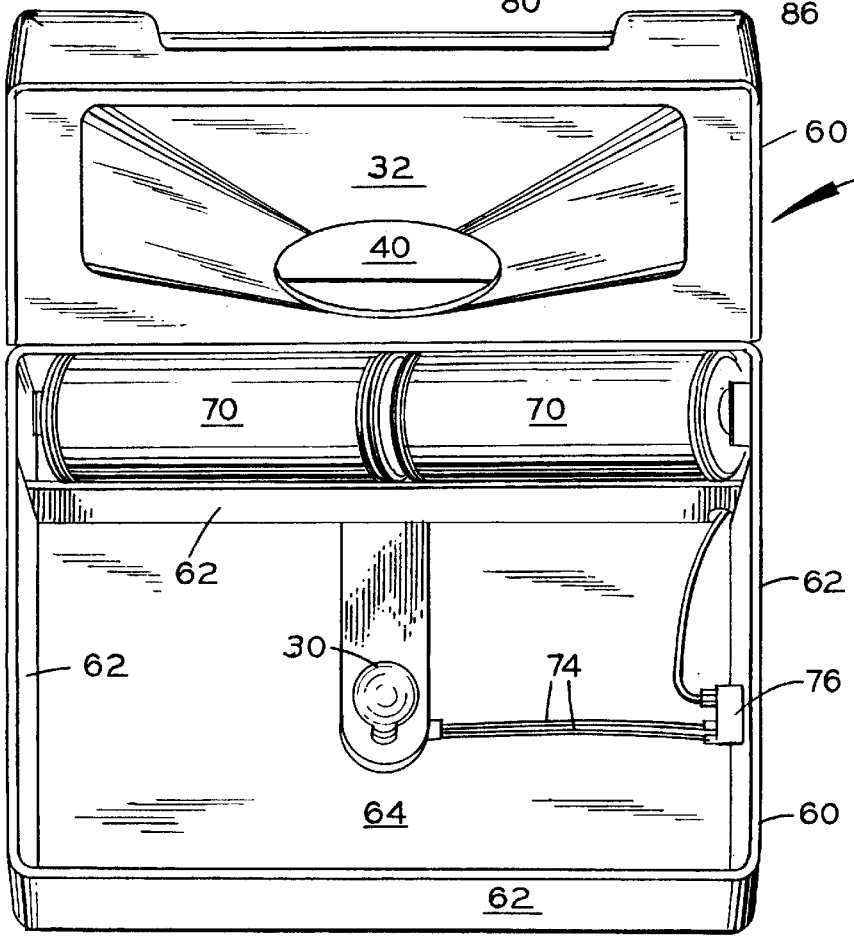
FIG. 3 is a perspective view of the apparatus of FIG. 1 with the housing opened to reveal the light source, power source and battery circuit, as well as the reflector.
Figure 2:
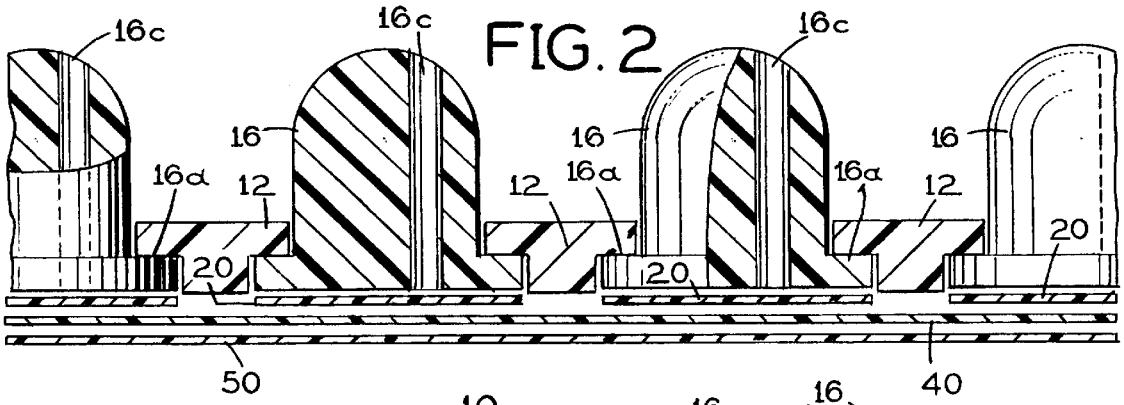
FIG. 2 is a partial cross-sectional side view of the display board and two pegs, showing the relative positions of the mounting panel, tape sheet and film sheet.
Figure 4:
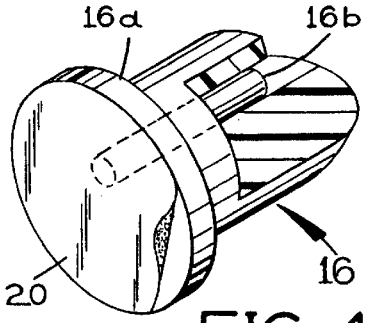
FIG. 4 is a perspective view of an individual peg, showing the expanded peg distal end with the film section affixed to it.
Figure 6:
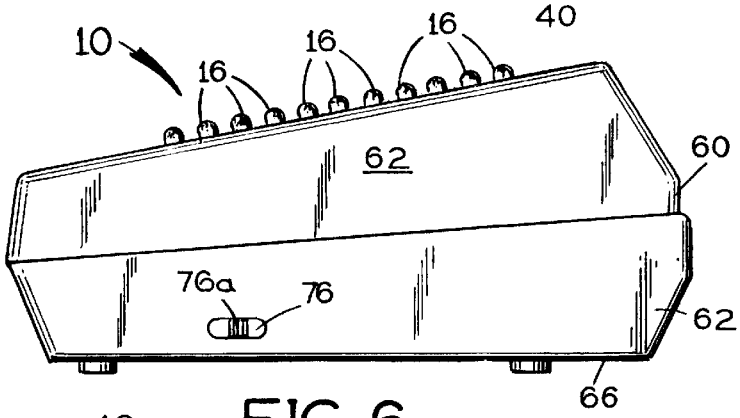
FIG. 6 is a side view of the apparatus housing, showing the switch actuating lever and opening the housing.
Figure 5:
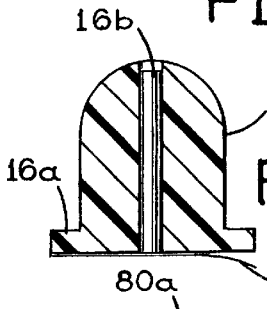
FIG. 5 is a cross-sectional side view of one of the pegs, revealing the fiber optic filament.
Figure 7:
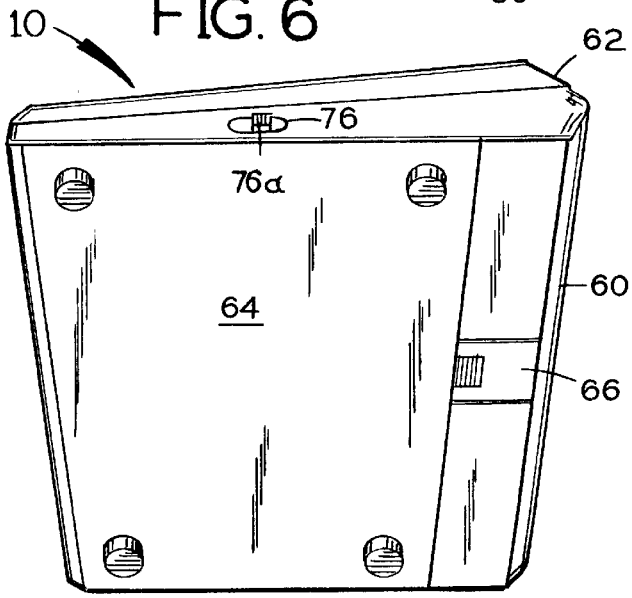
FIG. 7 is bottom perspective view of the apparatus housing of FIG. 6.
Figure 9:
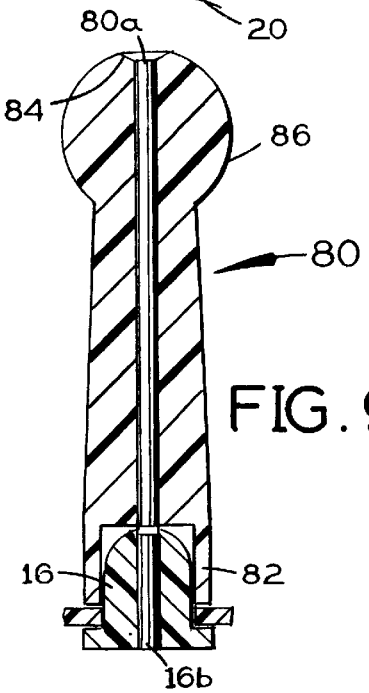
FIG. 9 is a cross-sectional side view of the preferred wand, showing the fiber optic filament inside.
Figure 8:
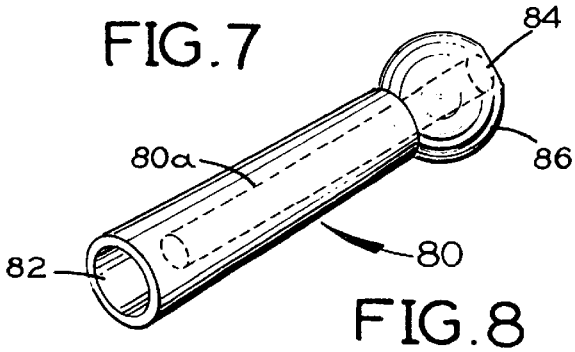
FIG. 8 is a perspective view of the preferred peg rotating wand.
Figure 10:
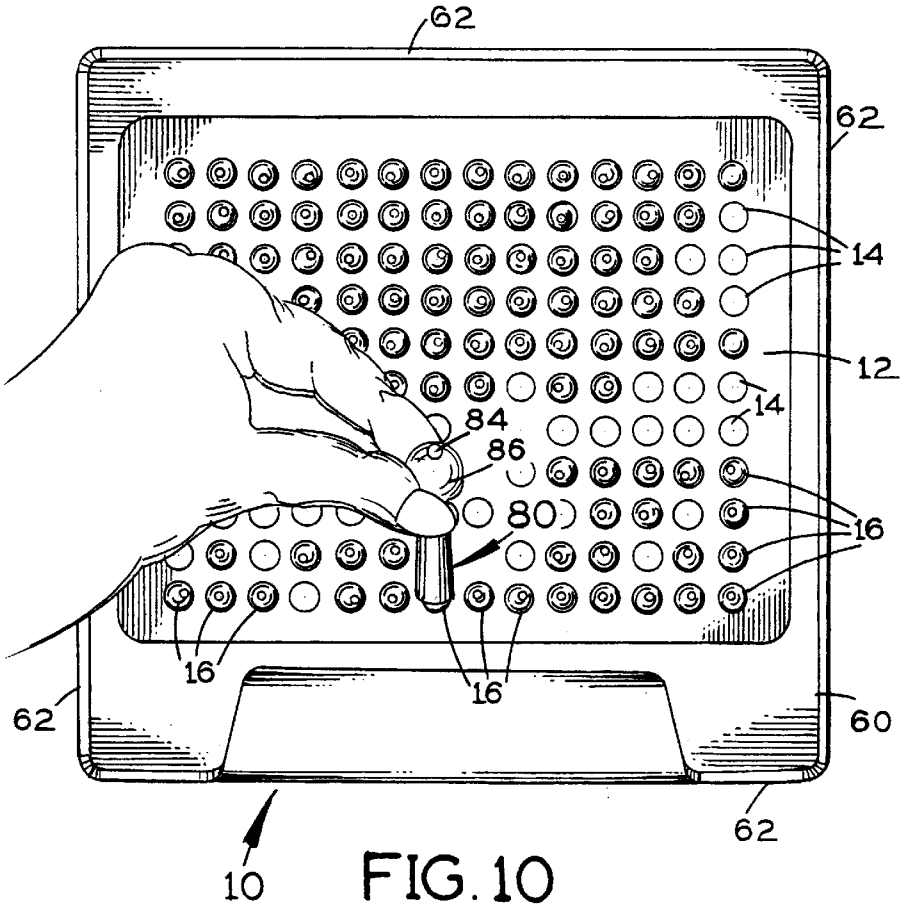
FIG. 10 is a view of the apparatus as in FIG. 1, with a player rotating a peg with the wand of FIG. 8.
Figure 11:
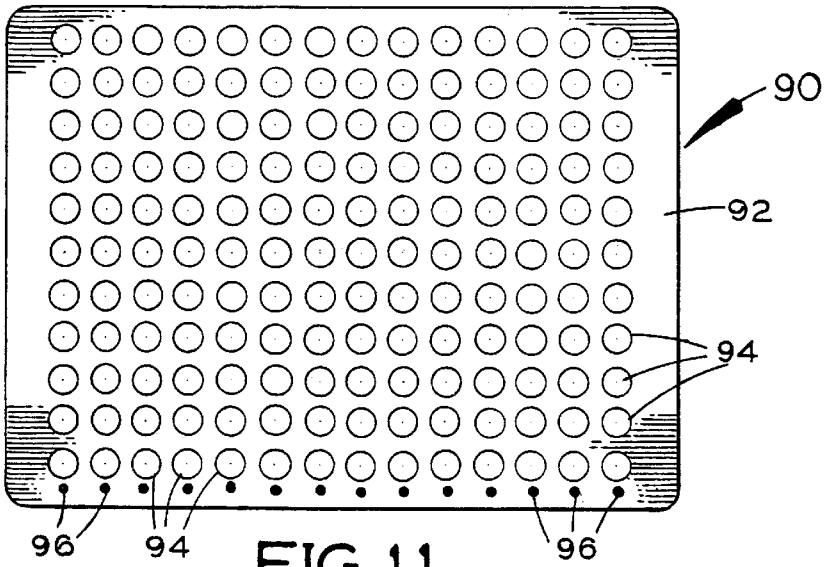
FIG. 11 is a perspective view of one of the optional templates.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1–11, an image generating apparatus 10 is disclosed including an image display board 12 having a grid of peg ports 14, each peg port 14 being rotatably fitted with a translucent colorless peg 16 having a planar distal end laminated with a section 20 of transparent polarized film sheet. A light source 30 is provided behind the board 12, and a clear transparent polycarbonate mounting panel 22 formed of plastic or glass extends between light source 30 and the peg 16 distal ends, in close proximity to the peg 16 distal ends. See FIGS. 1–3. A polarized tape sheet 50 is secured face to face with the mounting panel to extend between light source 30 and the peg 16 distal ends, and a polarized film sheet 40 is secured face to face to the tape sheet 50 to extend between tape sheet 50 and light source 30, and tape sheet 50 is mounted to extend between film sheet 40 and the peg 16 distal ends. Film sheet 40 and film sections 20 are preferably formed of full wave retarder material such as POLAROID™ part number 605209, 530, +20 nannos or part number 621129, 560, + or −20 nannos, and tape sheet 50 is preferably formed of 3M™ or SCOTCH™ tape or cellophane. Each peg 16 has a peg longitudinal axis extending between the peg 16 distal end and the peg 16 proximal end, and a fiber optic filament 16*b* preferably extends through each peg 16 along the peg longitudinal axis for enhanced light transmission from the peg 16 distal end to the peg 16 proximal end. The polarization axis of tape sheet 50 is preferably oriented at an angle, preferably a forty-five degree angle, relative to the polarization axis of film sheet 40.

As a result of this construction, light shining through film sheet 40, through tape sheet 50, and through the film section 20 at the peg 16 distal ends is refracted and a wavelength of visible light corresponding to a specific color or hue is isolated and passes into each given peg 16. The isolated wavelength illuminates the given peg 16 so that the peg 16 glows the corresponding color when seen from the outward side of display board 12. Of great significance to the present invention is that rotating any given peg 16 causes the film section 20 polarization axis to shift alignment with film sheet 40 and tape sheet 50 axes, thereby shifting the selected wavelength to project a different color into the peg 16. This color shift progresses throughout the entire visible color spectrum over each half rotation of the peg 16, so that any color may be selected simply by stopping peg 16 rotation the moment the color appears. By selecting different colors for the various pegs 16 on display board 12, an illuminated color pattern or a picture may be created.

Display board 12 is preferably the forward wall of an apparatus housing 60 containing light source 30, film sheet 40 and tape sheet 50. Housing 60 preferably includes side walls 62 and a rear wall 64, and mounting panel 22 is secured to and between housing side walls 62. See FIGS. 3, 6 and 7. Film sections 20 are each preferably secured to peg 16 distal ends by first softening the peg 16 acrylic or polycarbonate material with methyl ethyl ketone, which makes the peg 16 distal ends adherent to sections 20.

Figure 12:
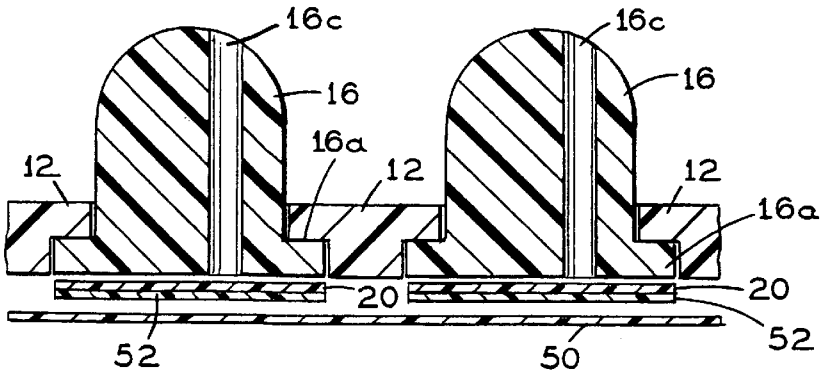
FIG. 12 is a view as in FIG. 2, showing the alternative construction, in which the tape sheet is replaced with a tape section on the distal face of each film section on each peg.

It is alternatively contemplated that tape sheet 50 may be omitted and instead a tape sheet section 52 may be secured to the distal face of the film section 20 on each peg 16. The resulting operation and color array illuminated within each peg 16 during peg 16 rotation is unchanged with this arrangement. See FIG. 12.

Pegs 16 are each preferably cylindrical and formed of lucite plastic, and have an expanded distal end 16*a* for rotatably abutting the display board 12 surfaces surrounding the peg port 14 into which they are snugly but rotatably fitted. Expanded distal ends 16*a* each preferably fit into a well in the form of a tubular flange 24 concentrically surrounding each peg port 14 and extending rearwardly from display board 12. See FIGS. 4 and 5.

Light source 30 is preferably a conventional incandescent bulb of low wattage. Light source 30 may alternatively be fluorescent lighting or light emitting diodes, or any other suitable light generating means. Housing 60 preferably contains a power source 70 in the form of several D batteries replaceably mounted in a conventional battery clip structure 72, and contains an electric circuit 74 for delivering power from power source 70 to light source 30. See FIG. 3. It is understood that power source 70 may take many other forms, including a 1½ volts from a battery of any size and could use 120 AC household electrical power or converters. A battery access door 66 is preferably provided in the housing rear wall 64 or side wall 62 for periodically accessing and replacing spent batteries. Power circuit 74 includes a switch 76 having a switch actuation lever 76*a* protruding through a switch opening in the housing 60 for controlling the flow of current to light source 30. Housing 60 preferably also contains a funnel-shaped reflector 32 opening at its narrow end around light source 30 and expanding toward and into fastening contact with the rear surface of mounting panel 22, directing light to all of the peg 16 distal ends. Reflector 32 may be made of foil, of vacuum-formed plastic with a mirror vapor deposition surface, or of any other suitable material.

Pegs 16 are preferably mounted close together and thus they can be difficult to grip between player finger tips. Therefore, to rotate pegs 16 to produce color changes, a wand 80 is preferably provided in the form of a clear translucent stem having a peg receiving opening 82 at the wand 80 distal end and a finger gripping portion 86 at the wand 80 proximal end. See FIGS. 8–10. Peg receiving opening 82 is preferably close enough to the peg 16 proximal end diameter that a friction fit is produced between the peg 16 and the opening 82 for peg 16 engagement during rotation. Alternatively the peg 16 and peg receiving opening 82 may be of corresponding geometric cross-sectional shapes for surface abutting engagement during peg 16 rotation. At the center of gripping portion 86 and of the wand 80 longitudinal axis is an unobstructed viewing section 84 into which the player looks to see the color of light entering the engaged peg 16 at each moment during peg 16 rotation, so that rotation may be stopped at the moment the desired color is projected into the peg 16. To enhance light transmission through wand 80, a fiber optic filament 80*a* is preferably provided within wand 80 along the wand 80 longitudinal axis.

An optional added feature is a set of templates 90 to aid the player in picture and pattern creation. Each template 90 includes a sheet of material 92, preferably a resilient plastic, having a grid of peg receiving holes 94 corresponding to each peg 16 on the display board 12. See FIG. 11. Each peg 16 preferably has a lateral notch 16*c*. Adjacent to each peg receiving hole 94 is a color mark 96 in the form of a dot corresponding to the color the particular adjacent peg 16 should be illuminated to produce a collective image. The mark 96 is located at a position around peg port 14 such that rotating the peg notch 16*c* to a position immediately adjacent to mark 96 orients the peg 16 to transmit the color needed to form the composite template 90 image. Two diametrically opposing marks 96 are preferably provided for each hole 94, because the same color is illuminated one hundred eighty degrees apart through peg 16 rotation. Alternatively the mark 96 may be pigmented with the necessary peg 16 color and the adjacent peg 16 is rotated until that color is illuminated in the peg 16. The player places the selected template 90 on display board 12 and rotates the pegs 16 one by one until each is illuminated with a color corresponding to the specific adjacent mark 96 colors. Each of template 90 produces an image unique to the set of templates.

Second Preferred Embodiment

Figure 13:
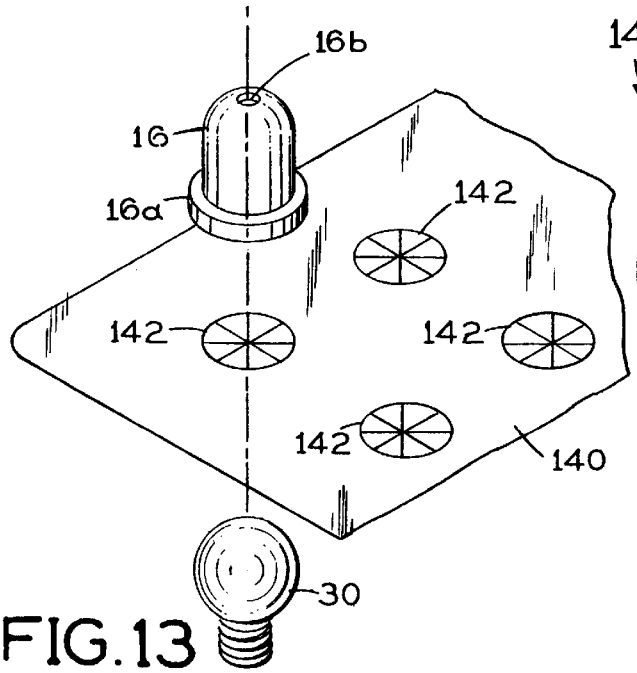
FIG. 13 is a perspective view of a portion of the second embodiment color film sheet with a peg elevated over one of the color selection patterns and the light source represented below the sheet.
Figure 14:
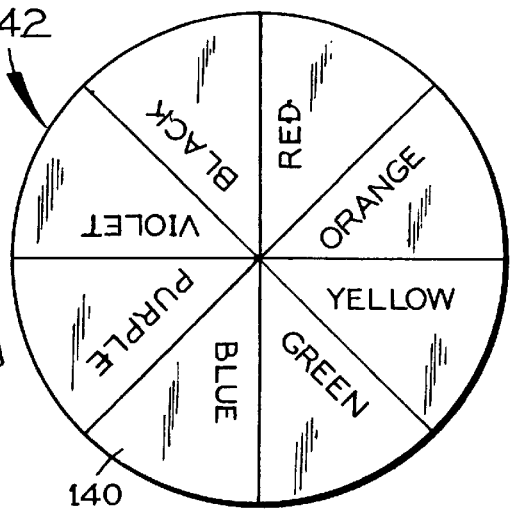
FIG. 14 is a close-up representation of a single color selection pattern. The colors shown and their arrangement are entirely exemplary and should not be construed as limiting.
Figure 16:
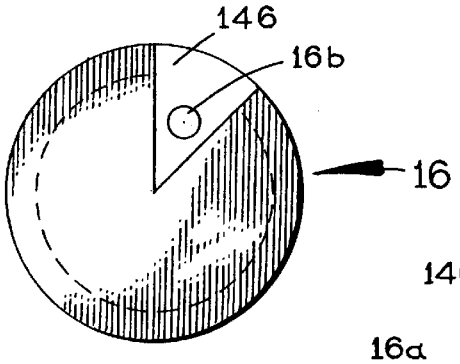
FIG. 16 is a bottom view of the peg of FIG. 15.
Figure 17:
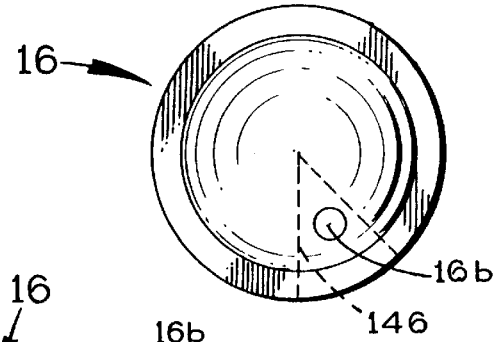
FIG. 17 is a top view of the peg of FIG. 15.

The second embodiment is like the first except that the polarized sheet 40, film sections 20 and the tape sheet 50 are replaced with a sheet of translucent color film 140 having color selection patterns 142 for each peg 16. A color selection pattern 142 is positioned directly below each peg 16, is preferably circular and includes an array of colors separated from each other by equally spaced radial divisions similar to pie cuts. See FIGS. 13 and 14. The diameter of each color selection pattern 142 is substantially equal to that of the face of a peg 16 distal end.

Figure 15:
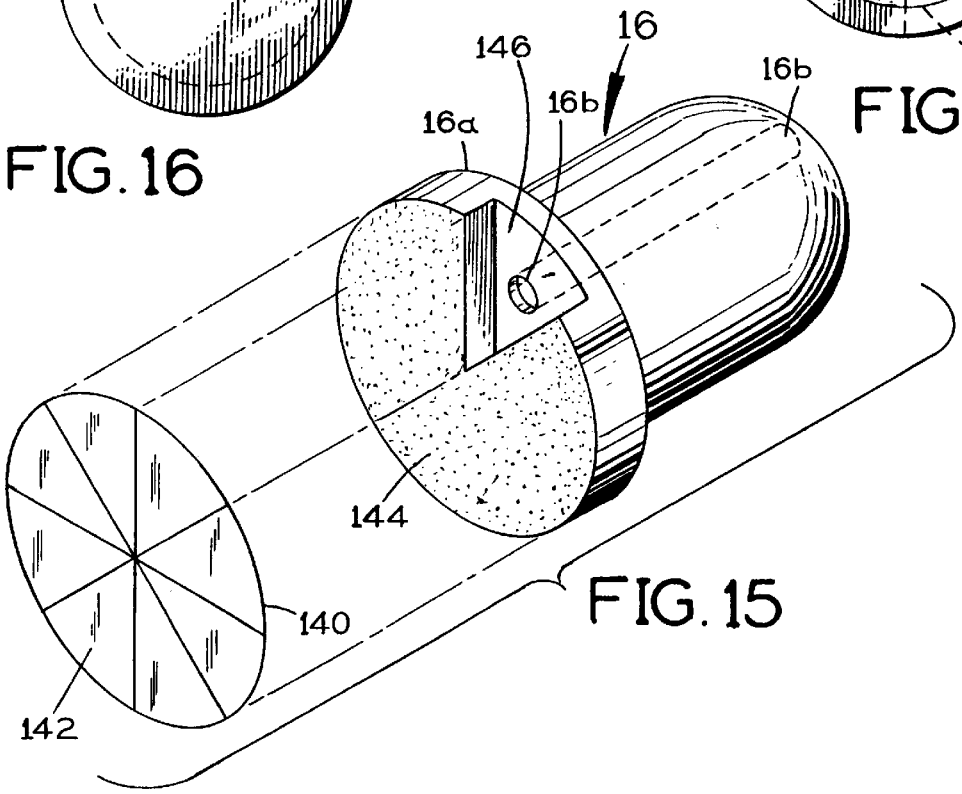
FIG. 15 is a perspective view of one of the pegs of the second embodiment showing the recessed translucent section of the peg distal end and a representation of a single color selection patter aligned for light transmission through one of the color divisions into the peg. The fiber optic filament meeting the recessed translucent section is also illustrated.
Figure 18:
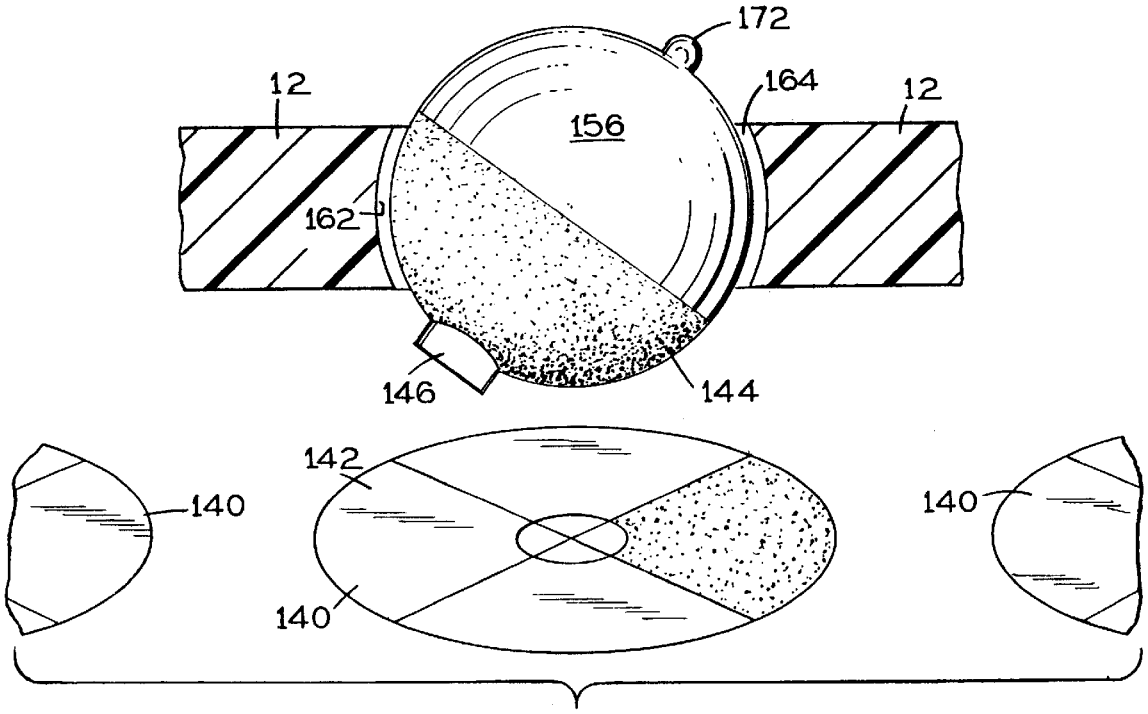
FIG. 18 is a cross-sectional side view of a segment of the display board for the tiltable ball variation of the second embodiment, showing the opaque ball distal half, the translucent section and the knob.
Figure 19:
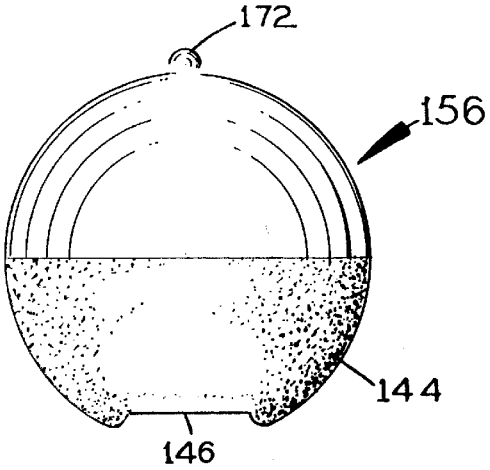
FIG. 19 is a cross-sectional side view of one of the translucent balls of the second embodiment having the recessed translucent section.
Figure 20:
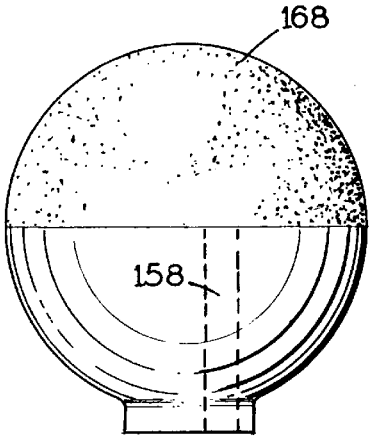
FIG. 20 is a side view of one of the translucent balls having the preferred fiber optic filament and frosted proximal half.
Figure 21:
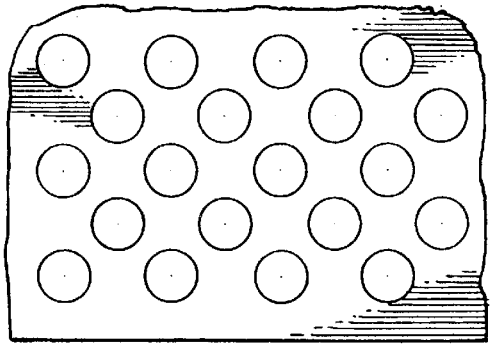
FIG. 21 is a partial representation of the alternative staggered peg or ball array on a display board.

The distal face of each peg 16 is covered with an opaque paint 144, except for a pie-shaped translucent section 146 of a size equal to that of each radial division of the color selection pattern 142 through which a selected color is transmitted into the peg 16. As a result, each peg 16 is capable of receiving and transmitting one or more colors at a time, colors blended together when section 146 overlaps a color border at a radial division. Translucent section 146 is preferably recessed so that the opaque paint 144 may be deposited during manufacture onto the remainder of the peg 16 distal face only. See FIGS. 13–17. For this embodiment, the fiber optic filament 16*b* extends laterally from the peg 16 longitudinal axis to open into the translucent section 146 where light is gathered. See FIG. 15.

As an alternative, pegs 16 may be replaced with translucent balls 156 tiltably mounted within concave edges 162 of ball ports 164 in display board 12. See FIGS. 18–21. The distal half of each ball 156 is covered with opaque paint 144, except for a translucent section 146. Translucent section 146 is preferably either recessed or protruded from the distal apex of each ball 156, once again, so that the opaque paint 144 may be deposited in a single step during manufacture onto the remainder of the ball 156 distal half only. It is preferred that translucent section 146 protrude, because it can then serve to abut the sides of the ball port 172 to stop the tilt of the ball 156 before the opaque distal half becomes exposed on the proximal side of display board 12. A protruding knob 172 is also preferably provided at the center of the ball 156 translucent upper half for the same abutment purpose. The balls 156 are tilted in ports 164 so that the translucent section 146 is positioned directly above a color section of the color selection pattern 142, or over the border of two color sections, to transmit the color or colors into the ball 156. The tilt orientation of the balls 156 may be changed by moving each with a finger or by sweeping several at a time with an artist's paint brush. Since such a sweep would tend to orient the brushed balls 156 to radiate the same color, the illusion is created of color application by the brush. One section of the color selection pattern 142 is preferably opaque, so that the balls 156 may be tilted to make board 12 entirely opaque to function as a blank slate to begin creation of a new image.

A fiber optic filament 158 preferably extends through each ball 156 from the translucent section 146 into the ball 156 translucent upper half. Filament 158 preferably terminates substantially at the center of the ball 156 so that light from the filament 158 is radiated in all directions to illuminate the entire upper half of the ball 156. The ball 156 upper half is alternatively buffed to produce a frosted surface 168 similar to diffuse light bulbs, to more evenly display the color transmitted through the ball 156.

It is to be understood that for this or any other display board 12 embodiments described in this application, the pattern of pegs 16 or balls 156 may be in a square grid, as illustrated in FIG. 1, or may take any other desired arrangement. One arrangement specifically contemplated is staggered lines, which places the pegs 16 or balls 156 closer together. See FIG. 21. It is also contemplated that the radial color divisions or borders in each color selection pattern 142 may be either sharp or blurred separations. A lens-shaped, convex protrusion 180 is preferably molded into the transparent mounting panel 22 below each peg 16 or ball 156 to better capture and direct light from light source 30 into the peg 16 or ball 156. See FIG. 2.

Third Preferred Embodiment

Figure 22:
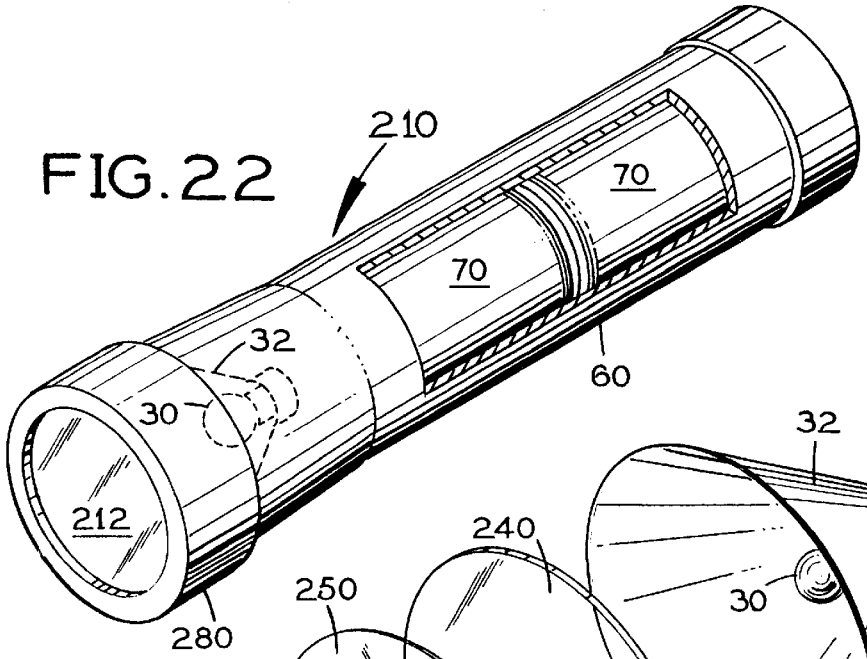
FIG. 22 is a cross-sectional side view of the third embodiment of the apparatus in a flashlight configuration.
Figure 23:
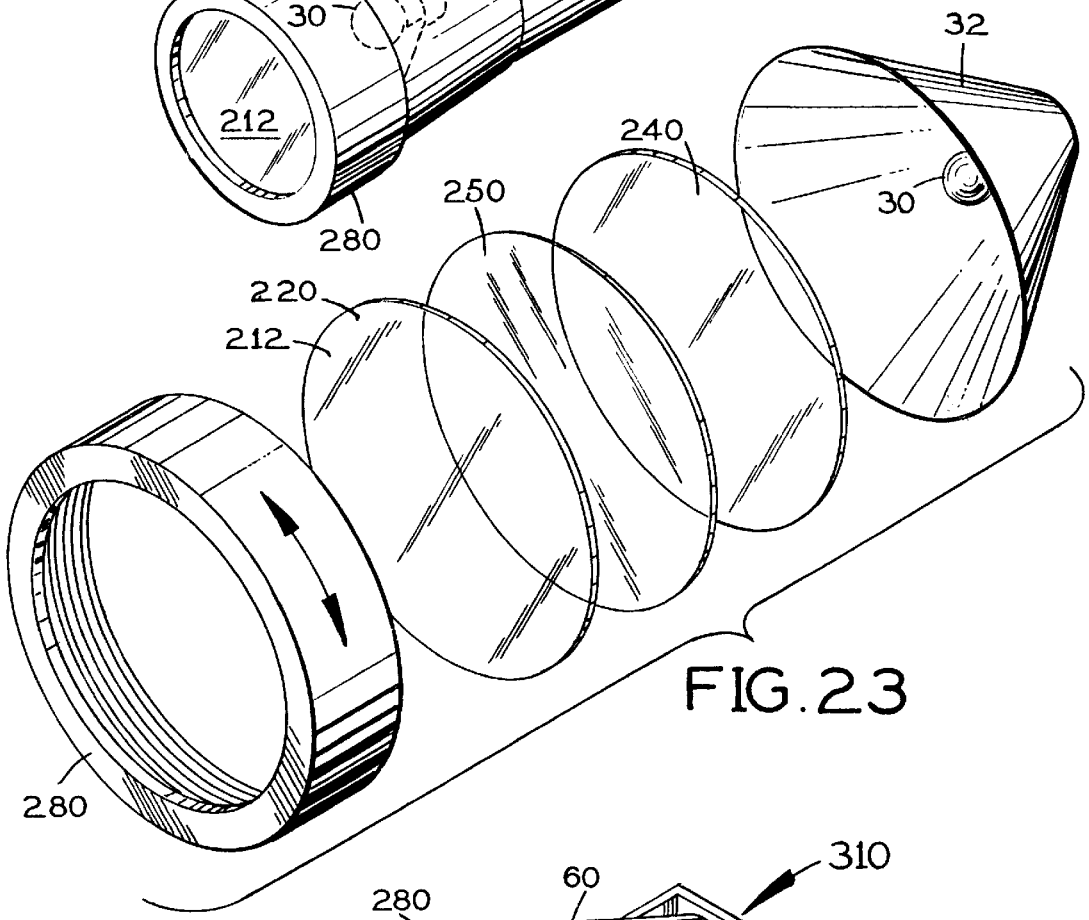
FIG. 23 is an exploded view of the light source, reflector, polarized sheets and tape sheet, and rotating lens mount ring.
Figure 24:
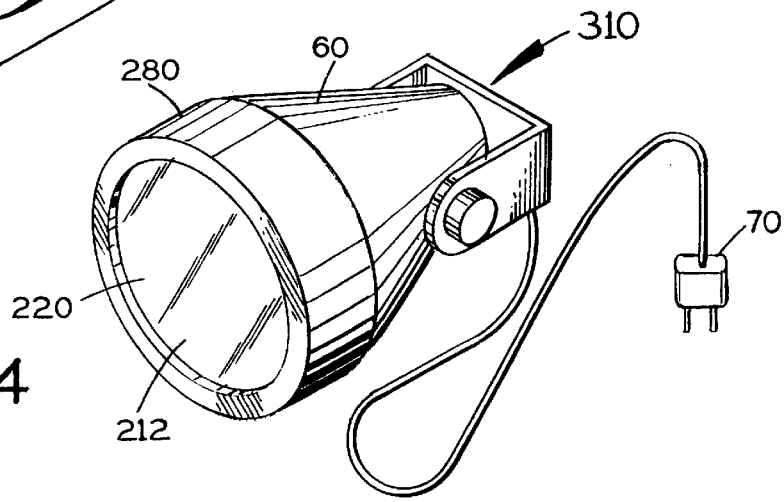
FIG. 24 is a perspective view of the third embodiment in a spotlight configuration.

The third embodiment is similar to the first or second except that it takes the form of a flashlight 210, the display board is omitted and no peg or ball is provided. See FIGS. 22–24. The light emitted from the flashlight lens 212 is of a single, changeable color.

The flashlight 210 is of conventional construction, except that a second disk 240 formed of a polarized sheet with a tape laminate 250 on the lens side of the sheet is rotatably mounted across the space between the light source reflector 232 and the lens 212. A first disk 220 is secured to the inner surface of the lens 212, and the lens 212 is mounted in a rotatable ring 280. Rotating lens 212 and first disk 220 relative to second disk 240 by rotating ring 280 produces the progressive color change described for the pegs 16 in the first embodiment. As a result, the lens 212 is not only illuminated the selected color or hue, but that color or hue is also radiated outwardly from flashlight 210 in the form of a colored flashlight beam.

The housing 60 of this embodiment may alternatively take the form of a spotlight 310 for the home or stage, or virtually any other desired form. See FIG. 24.

Method

In practicing the invention, the following method may be used. The player rotates the pegs 16 one by one until each is illuminated with a selected color so that the pegs 16 collectively illuminated with colors forming a desired pattern or picture.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. An image generating board apparatus, comprising:

an image display board having an array of member ports, a light source adjacent to said display board, said light source radiating visible light comprising a plurality of wavelengths, translucent members comprising translucent and colorless material fitted into each of at least two said member ports, each said translucent member having a member distal end adjacent to said light source and which is substantially planar, each said translucent member having a member proximal end, and each said translucent member having a longitudinal axis and being rotatable independently relative to other said translucent members, a translucent color sheet mounted to extend between said light source and said member distal ends, and means for selecting the wavelength of light passing into each of a plurality of said translucent members, such that light from said light source shines through said color sheet, at said member distal ends and selectively passes into each said translucent member at least one said wavelength of visible light from said light source, said selected wavelength illuminating each said translucent member with a color corresponding to each said selected wavelength, and such that said means for selecting comprises rotation of any given said translucent member to cause another said wavelength of visible light to pass into the given said translucent member and project into said translucent member a different illuminated color.

2. An apparatus according to claim 1, wherein said color sheet has printed on it a color selection pattern adjacent to each member distal end including an array of translucent colors substantially separated by radial lines intersecting at a point substantially co-linear with the longitudinal axis of the adjacent member, and wherein each said translucent member has an opaque region and a translucent region, said translucent region being sized to pass light from said light source from only a part of said color array.

3. An image generating board apparatus, comprising:

an image display board having at least two member ports, translucent members comprising translucent material tiltably fitted into each of at least two said member ports, each said translucent member having a member distal end and a member proximal end, and each said translucent member having a longitudinal axis and being independently tiltable relative to other said translucent members, a light source directed toward said display board and toward said member distal ends, said light source radiating visible light comprising a plurality of wavelengths, a translucent color sheet mounted to extend between said light source and said member distal ends, said light source radiating visible light comprising a plurality of wavelengths, such that light from said light source shines through said color sheet, at said member distal ends and selectively passes into each said translucent member at least one selected wavelength of visible light from said light source, said selected wavelength illuminating each said translucent member with a color corresponding to each said selected wavelength, and such that tilting any given said translucent member shifts the wavelength selected and projects into said translucent member to a different illuminated color.

4. An apparatus according to claim 3, wherein said translucent members are each a sphere.

5. An apparatus according to claim 4, wherein each said sphere has a frosted proximal end for diffusing light entering said sphere through said distal end.

6. An apparatus according to claim 3, wherein said color sheet has printed on it a color selection pattern adjacent to each member distal end including an array of translucent colors substantially separated by radial lines intersecting at a point substantially co-linear with the longitudinal axis of the adjacent member, and wherein each said translucent member has an opaque region and a translucent region, said translucent region being sized to pass light from said light source from only a part of said array of translucent colors.

7. An apparatus according to claim 3, wherein said translucent members each contain a fiber optic filament extending from the member distal end toward the member proximal end.

8. An image generating board apparatus, comprising:

an image display board having an array of member ports, a light source adjacent to said display board, said light source radiating visible light comprising a plurality of wavelengths, translucent members comprising translucent and colorless material fitted into each of at least two said member ports, each said translucent member having a member distal end adjacent to said light source and which is substantially planar, each said translucent member having a member proximal end, and each said translucent member having a longitudinal axis and being rotatable independently relative to other said translucent members, a translucent color sheet mounted to extend between said light source and said member distal ends, and means for selecting the wavelength of light passing into each of a plurality of said translucent members, such that light from said light source shines through said color sheet, at said member distal ends and selectively passes into each said translucent member at least one wavelength of visible light from said light source, said selected wavelength illuminating each said translucent member with a color corresponding to each said selected wavelength, and such that said means for selecting comprises rotation of any given said translucent member to cause another said wavelength of visible light to pass into the given said translucent member and project into said translucent member a different illuminated color, wherein said color sheet has printed on it a color selection pattern adjacent to each member distal end including an array of translucent colors substantially separated by radial lines intersecting at a point substantially co-linear with the longitudinal axis of the adjacent member, and wherein each said translucent member has an opaque region and a translucent region, said translucent region being sized to pass light from said light source from only a part of said color array.

9. An image generating board apparatus, comprising:

an image display board having at least two member ports, translucent members comprising translucent material tiltably fitted into each of at least two said member ports, each said translucent member having a member distal end and a member proximal end, and each said translucent member having a longitudinal axis and being independently tiltable relative to other said translucent members, a light source directed toward said display board and toward said member distal ends, said light source radiating visible light comprising a plurality of wavelengths, a translucent color sheet mounted to extend between said light source and said member distal ends, said light source radiating visible light comprising a plurality of wavelengths, such that light from said light source shines through said color sheet, at said member distal ends and selectively passes into each said translucent member at least one selected wavelength of visible light from said light source, said selected wavelength illuminating each said translucent member with a color corresponding to each said selected wavelength, and such that tilting any given said translucent member shifts the wavelength selected and projects into said translucent member to a different illuminated color, wherein said translucent members are each a sphere.

10. An apparatus according to claim 9, wherein each said sphere has a frosted proximal end for diffusing light entering said sphere through said distal end.

* * * * *